US005190088A

United States Patent [19]

Thomassen et al.

[11] Patent Number: 5,190,088

[45] Date of Patent: Mar. 2, 1993

[54] METHOD AND APPARATUS FOR COMPRESSING A WOOD SAMPLE

[75] Inventors: Thomas Thomassen, Jægerspris; Jens Ljørring, Virum; Ove Hansen, Køge, all of Denmark

[73] Assignee: Dansk Teknologisk Institut, Taastrup, Denmark

[21] Appl. No.: 768,248

[22] PCT Filed: Aug. 23, 1990

[86] PCT No.: PCT/DK90/00219

§ 371 Date: Oct. 15, 1991

§ 102(e) Date: Oct. 15, 1991

[87] PCT Pub. No.: WO91/02637

PCT Pub. Date: Mar. 7, 1991

[30] Foreign Application Priority Data

Aug. 24, 1989 [DK] Denmark ..... 4183/89

[51] Int. Cl.[5] ..... B27M 1/02; B30B 1/32

[52] U.S. Cl. ..... 144/361; 100/38; 100/269 A; 144/2 R; 144/348; 144/352; 144/380; 269/22

[58] Field of Search ..... 100/38, 211, 269 A; 144/2 R, 49 R, 348, 352, 361, 380, 257, 256.2; 269/20, 22

[56] References Cited

U.S. PATENT DOCUMENTS

| | | | |
|---|---|---|---|
| 1,542,576 | 6/1925 | Pfleumer | 144/380 |
| 2,586,308 | 6/1948 | Curtis | 144/280 |
| 3,166,110 | 1/1965 | Van Hartesveldt et al. | 144/380 |
| 4,017,980 | 4/1977 | Kleinguenther | 144/380 |

FOREIGN PATENT DOCUMENTS

| | | |
|---|---|---|
| 516801 | 1/1931 | Fed. Rep. of Germany . |
| 3033802 | 4/1982 | Fed. Rep. of Germany . |

*Primary Examiner*—W. Donald Bray

*Attorney, Agent, or Firm*—Merchant, Gould, Smith, Edell, Welter & Schmidt

[57] ABSTRACT

A heated wood sample (46) having a water content exceeding 20 percent is compressed axially in the direction of the grain or fibres of the sample in a compression mould (10). Oppositely directed compressive forces are applied not only to the end surfaces of the sample, for example by means of a hydraulic cylinder (18), but also to side surface parts of the sample as frictional forces. The sample may be arranged within a compression chamber which is at least partly defined by longitudinally overlapping side wall parts (30, 37, 47, 48), which are mutually displaceable in the longitudinal direction of the chamber, and these side wall parts may be pressed into frictional engagement with the sample (46) for example by means of an inflatable bag or an inflatable hose section (32, 34), and means may be provided for mutually displacing the side wall parts so as to apply frictional compressive forces to the wood sample. The side wall parts or friction plates may engage with longitudinally spaced sections of the sample (46), if desired. However, if a substantially uniform compression along the length of the sample desired, the side wall parts are preferably arranged in parts (30, 37 and 47, 48) of oppositely positioned wall parts each of which extends along substantially the total length of the sample. The hydraulic cylinder (18) by means of which compressive forces are applied to the end surfaces of the sample, may simultaneously displace one pair of the oppositely positioned side wall parts longitudinally in relation to the other pair of side wall parts. The longitudinally compressed wood sample may be bent and shaped much more easily than a corresponding non-compressed sample.

10 Claims, 2 Drawing Sheets

METHOD AND APPARATUS FOR COMPRESSING A WOOD SAMPLE

Figure 1:
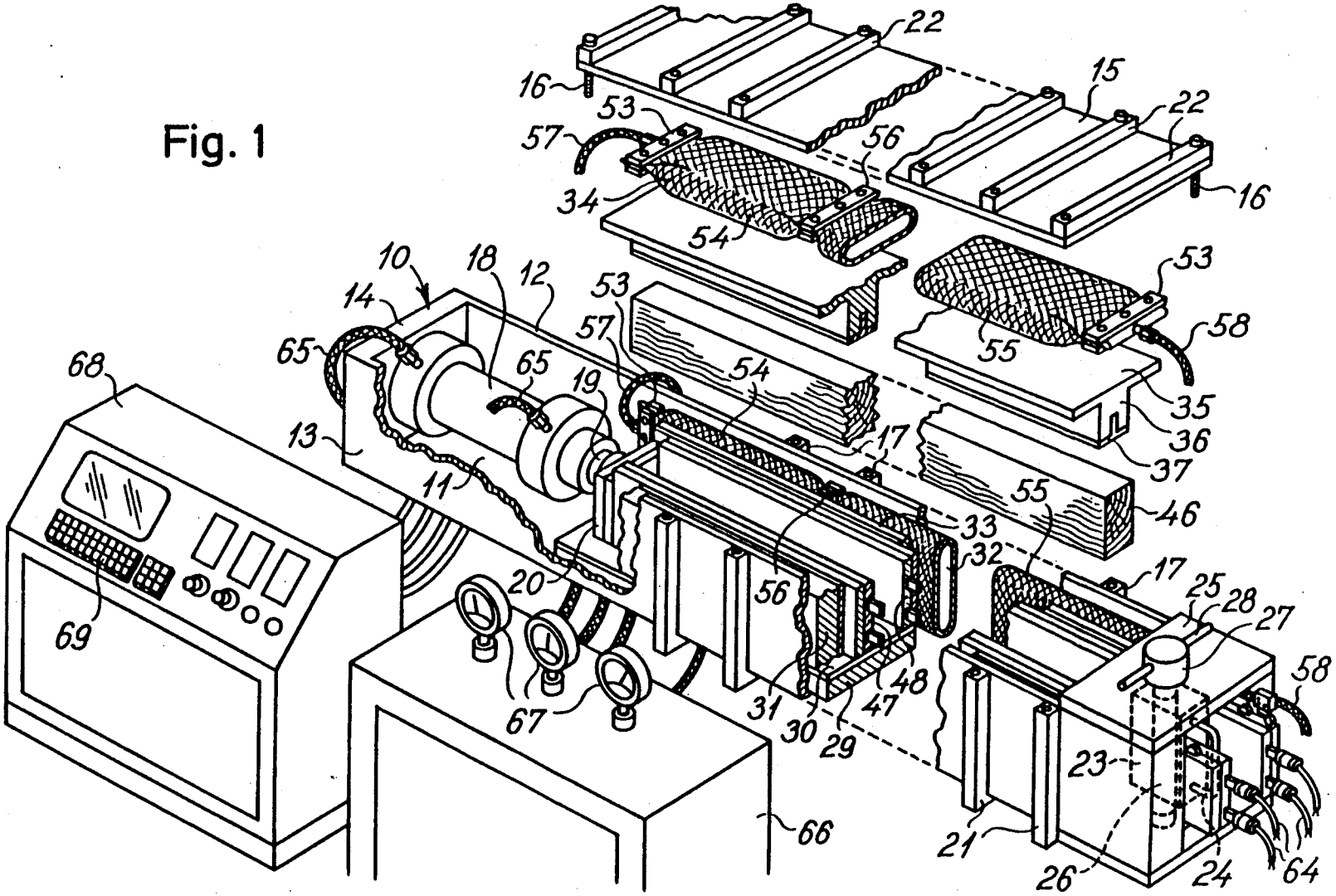

The present invention relates to a method of compressing a wood sample.

It is well known that a wood sample may easily be bent transversely to the direction of the grain or fibres of the sample if the sample has previously been exposed to a boiling or steam treatment and subsequently compressed in the direction of the grain or fibres while preventing deflection of the sample. After bending and drying the compressed wood sample will retain its bent shape. When the opposite ends of a relatively long prismatic wood sample are exposed to compressive forces in a compression mould having side walls, which are pressed into firm engagement with the side surfaces of the sample, it is known that the end portions of the sample are compressed to a much higher extent than the intermediate central portion.

German patent specification No. 516,801 discloses a method and apparatus for compressing an elongated wood sample, wherein oppositely directed longitudinal compressive forces are applied not only to the end surfaces of the prismatic sample, but also to side surface parts thereof. In the known method and apparatus compressive forces are applied to the opposite end portions of the sample by means of force transmitting plates having serration-like projections for engaging with side surface parts of the wood sample. All side surfaces of each end portion of the sample is in engagement with such force transmitting plates, and compressive forces are applied to the force transmitting plates by means of pressure pistons, which are also acting on the opposite end surfaces of the wood sample.

In the known method and apparatus, the force transmitting plates do not extend along or over a substantial central longitudinal portion or section or along or over substantial central parts of the wood sample in order to allow for a substantial shortening of the sample under the influence of the compressive forces. This means that the method and apparatus disclosed in the above German patent specification does not render it possible to obtain a substantially uniform or sufficiently or adequately uniform compression along the length of the sample. This is especially true when relatively long wood samples are to be compressed. Furthermore, by using the above known method and apparatus the central longitudinal portion of the sample, which is not covered by the force transmitting plates, is not properly supported so as to prevent undue deflection.

The present invention provides a method and apparatus allowing for a substantially or more uniform compression of a wood sample along the whole length thereof. Thus, the present invention provides a method of compressing an elongated wood sample, said method comprising applying to the sample oppositely directed compressive forces substantially in the direction of the grain or fibres of the sample, said compressive forces comprising oppositely directed frictional forces being applied to side surface parts of the sample, and simultaneously preventing deflection of the sample, and the method according to the invention is characterized in applying the oppositely directed frictional forces to longitudinally overlapping side surface parts of the sample.

The term "longitudinally overlapping side surface parts" is intended to mean that said side surface parts extend at least partly along a common length portion of the sample while they are transversely spaced or positioned adjacent to one another.

By applying the oppositely directed frictional forces to overlapping side surface parts it is possible to obtain a substantially uniform compression of the sample along the length thereof or to compress one or more selected length portions of the sample at any position or positions of the sample, because the longitudinally overlapping side surface parts of the sample may be transversely spaced so that the force transmitting means used for transmitting the frictional forces to the overlapping side surface parts of the sample do not meet, but may pass each other despite the extent to which the sample is longitudinally compressed.

In case it is desired to compress one or more longitudinal portions of the sample longitudinally spaced from the free ends the compressive forces may be applied exclusively to side surface parts of the sample as frictional forces. However, oppositely directed compressive forces are preferably also applied to opposite end surfaces of the sample.

Deflection of the sample may be prevented by resiliently applying transversely directed forces to side surfaces of the sample so that the sample is allowed to expand transversely to some extent when compressed axially. However, the transversely directed forces which are applied to the side surfaces of the sample may be varied during the axial compression and/or the transverse forces applied to the side surfaces of the sample may be different along the length of the sample, if desired.

As mentioned above, the oppositely directed frictional forces may be applied to overlapping side surface parts at one or more longitudinally spaced positions of the sample. In the preferred embodiment, however, each of the surface parts to which the frictional forces are applied, extends in substantially the total length of the sample. As an example, frictional forces directed in a first longitudinal direction of the sample may be applied to one or more adjacent first side surfaces of the sample, while frictional forces directed in a second longitudinal direction opposite to said first direction may be applied to one or more adjacent second side surfaces of the sample adjacent to and/or opposite to the first side surface or surfaces. It should be understood that the frictional forces may be applied to the total area or part of the area of each side surface.

In the preferred embodiment the frictional forces are applied to a pair of opposite side surface parts for each of said opposite directions. This is especially advantageous when the wood sample has a square or rectangular cross-sectional shape. The wood sample may, however, have any other cross-sectional shape, such as triangular, quadrangular, pentagonal, hexagonal, etc. or any combination thereof. Alternatively. The wood sample may have a circular, ellipsoidal or any other round cross-sectional shape or any combination thereof.

The frictional forces applied to the side surface parts of the wood sample may be substantially uniform along the length of the sample. Alternatively, however, the frictional forces applied to the side surface parts of the sample may vary in the longitudinal direction of the sample, for example in order to obtain a non-uniform compression of selected longitudinal parts of the sample whereby the bending characteristics of the sample may be made different at different longitudinally spaced positions of the sample.

The wood sample is preferably pretreated prior to or during the compression of the sample, for example by heat, radio-wave or microwave radiation, visible or invisible light radiation, steam, and or chemicals. Normally, the wood sample is pretreated uniformly in its total length. It is possible, however, to pretreat only one or more longitudinally spaced sections of the sample in order to obtain special bending characteristics of the sample at selected positions only.

The wood sample may be separated into a plurality of subsamples by longitudinally extending cuts prior to or after the compression treatment. Normally, the sample to be treated in accordance with the method according to the present invention is of an elongated configuration.

The present invention also provides an apparatus for compressing a wood sample, said apparatus comprising means for applying to side surface parts of the sample oppositely directed frictional forces in the direction of the grain or fibres of the sample, and means for preventing deflection of the sample, the apparatus being characterized in that the means for applying frictional forces to the sample are adapted to frictionally engage with longitudinally overlapping side surface parts of the sample.

The apparatus may comprise means defining a chamber for receiving the sample, said chamber being at least partly defined by longitudinally overlapping side wall parts which are mutually displaceable in the longitudinal direction of the chamber, means for pressing said side wall parts into frictional engagement with the sample received in the chamber, and means for mutually displacing said side wall parts so as to apply frictional compressive forces to the wood sample.

The overlapping side wall parts for engaging with transversely adjacent or transversely spaced side wall parts of the sample may have sample engaging surfaces allowing more or less positive frictional engagement with the side surface parts of the sample. Thus, these surfaces may be more or less smooth, or they may be provided with friction increasing formations such as a plurality of projections, for example of the type disclosed in the above German patent specification.

The means for applying oppositely directed compressive forces to opposite end surfaces of the sample may comprise chamber end wall parts mutually displaceable in the longitudinal direction of the chamber, and force generating means for applying compressive forces to at least one of the end wall parts so as to displace the end wall parts towards each other, said side wall parts being connected to or drivingly connectable with either one of the end wall parts, whereby mutual displacement of the end wall parts by the force generating means causes mutual displacement of the overlapping side wall parts. The same force generating means may then be used not only for displacing the end wall part or parts, but also for mutually displacing the overlapping side wall parts of the apparatus. The end wall parts and the associated side wall parts may be interconnected so that the side wall parts are moved together with the associated end wall part. Alternatively, the arrangement may be such that the side wall parts are not moved together with the associated end wall part until the end wall part has been moved a predetermined length so as to initially compress the wood sample before frictional compressive forces are applied to the sample.

One of the end wall parts of the apparatus and the associated side wall parts may be stationarily mounted in relation to a frame of the apparatus, while the other end wall part and the associated side wall parts are longitudinally movable in relation thereto by means of the force generating means which may, for example, comprise a pressure fluid operated cylinder, such as a hydraulic cylinder.

The means for pressing the side wall parts into frictional engagement with the sample may comprise resilient means, such as an inflatable bag or hose or other types of inflatable means. Preferably, the inflatable means are divided into two or more individually inflatable and deflatable longitudinal sections, whereby different compressive frictional forces may be applied to various longitudinal sections of the wood sample, if desired. Furthermore, the pressure applied to longitudinal sections of the side wall parts by the pressing means may be relieved when such side wall part sections are no longer in contact with the wood sample because the length of the sample has been reduced by the compression.

Figure 2:
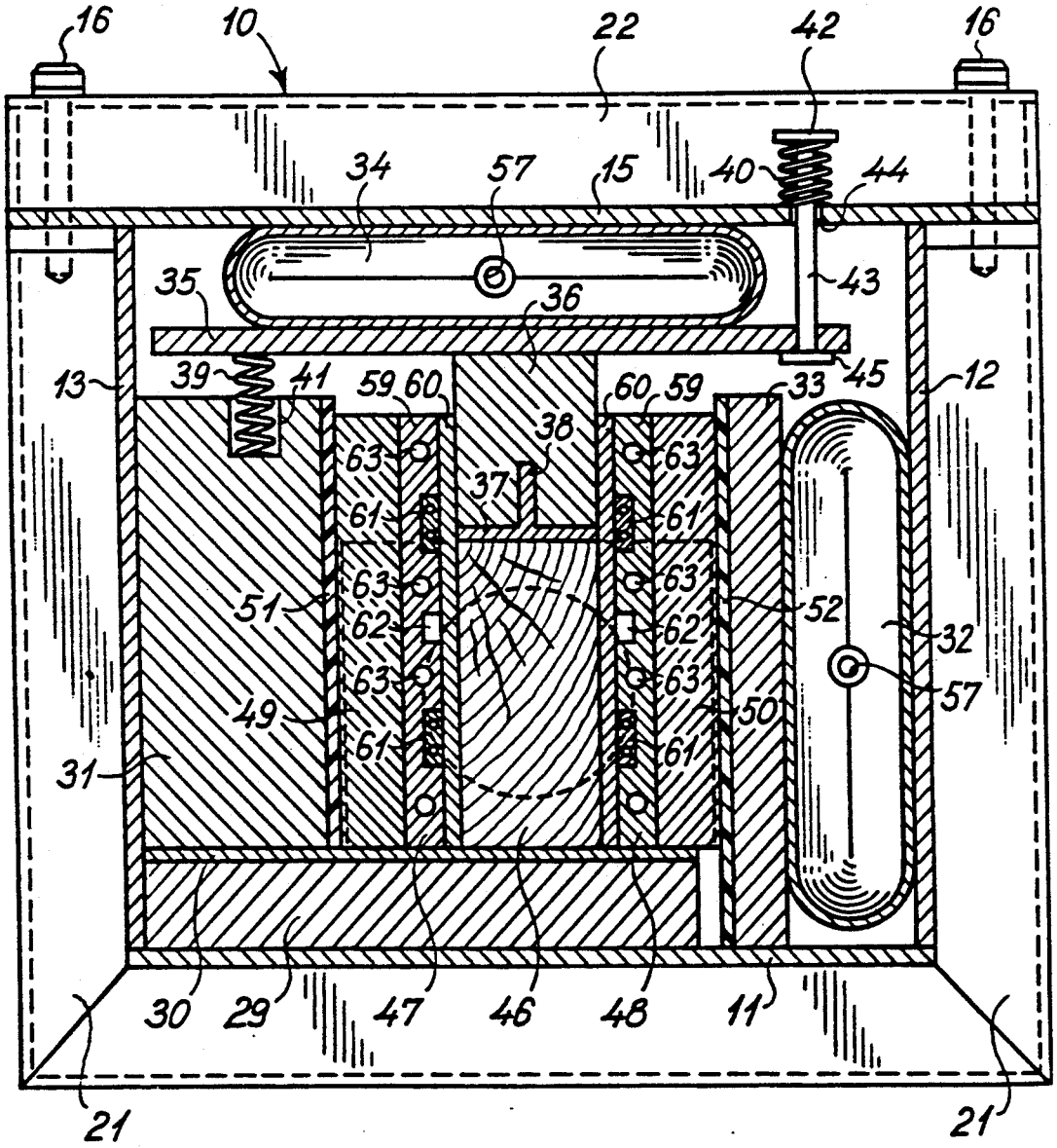

The invention will now be further described with reference to the drawings, wherein FIG. 1 is a perspective view and partly exploded view of an apparatus according to the invention, and FIG. 2 is a cross-sectional view of the compression mould of the apparatus shown in an enlarged scale.

The apparatus comprises a box-shaped compression mould 10 having a bottom wall 11, a pair of opposite side walls 12 and 13, and an end wall 14 forming a box or channel shaped integral unit open upwardly and at one end. The upward opening of the channel-shaped unit may be partly closed by a top wall 15, which may be connected to the unit by releasable fastening means, such as bolts or screws 16, which may be screwed into threaded bores 17 in the channel-shaped unit. The length of the top wall 15 is shorter than the length of the channel-shaped unit, which is left open at one end (the left-hand end in FIG. 1) when the top wall 15 has been mounted. A double-acting hydraulic cylinder 18 arranged within the open end portion of the mould 10 is mounted on the end wall 14, and a compression plate or member 20 is removable connected to the free end of a piston rod 19 of the cylinder. The bottom and side walls 11, 12 and 13 are stiffened or strengthened by means of substantially U-shaped outer stiffening members 21, which are mutually spaced along the length of the mould 10 and in which the threaded bores 17 are formed. The top wall 15 are also stiffened or strengthened by means of corresponding outer, substantially rectilinear stiffening members 22 extending transversely to the mould 10 and being mutually spaced so as to substantially register with the respective stiffening members 21. The outer stiffening members 21 and 22 may, for example, be welded to the outer surfaces of the bottom and side walls 11–13 and to the outer surface of the top wall 15, respectively.

A block-shaped abutment member 23 having a hand grip 24 may be mounted in the open end of the mould 10 opposite to the end wall 14 on which the cylinder 18 is mounted. This end portion of the mould is upwardly closed by means of a top wall section 25, which is permanently fixed to the side walls 12 and 13, for example by welding, and the abutment member 23 is secured in position by means of a locking bolt 26, which may be inserted through aligned openings in the top wall section 25, the abutment member 23, and the bottom wall 11, which may have an increased thickness at this end portion of the mould as indicated in FIG. 1 of the drawings. The locking bolt 26 has an enlarged head 27 with a transversely extending gripping member 28. The transverse space defined between the opposite inner surfaces of the side walls 12 and 13 exceeds the width of the block-shaped abutment member 23 so that open spaces are defined on either side of the abutment member 23.

A backing plate 29, which is supported by the inner surface of the bottom wall 11, has an upper surface supporting a friction plate or layer 30. A backing plate or backing block 31 engaging with the inner side surface of the side wall 13 is supported by the friction plate 30. An inflatable hose or an elongated inflatable bag 32 extends along the side wall 12 and is located between the inner surface of the side wall 12 and a pressure plate 33 which is supported by the bottom wall 11.

An inflatable hose or bag 34 extending in the longitudinal direction of the mould 10 is located between the inner surface of the top wall 15 and a pressure plate 35 and is in abutting engagement with a longitudinally extending beam-like backing member 36. The inner wall of the beam-like backing member 36 is covered by a friction member 37 having a T-shaped cross-section. A web-portion 38 of the friction member 37 is embedded in the beam-like backing member 36 or is received in a slot defined therein so that the backing member 36 and the friction member 37 form an integral unit. The pressure plate 35 is movably suspended by means of compression springs 39 and 40. The lower end portion of the compression springs 39 are received in bores 41 formed in the upper surface of the backing plate 31, and the upper ends of the springs 39 are in abutting engagement with the bottom surface of the pressure plate 35. The lower ends of the springs 40 are in abutting engagement with the upper surface of the top wall 15 while the upper end of each of the springs 40 are in abutting engagement with a flange or head 42 formed at the upper end of suspension bolt 43 extending through the compression spring 40 and through an opening 44 formed in the top wall 15. The lower end of the bolt 43 is connected to the pressure plate 35, for example by means of a lower head or flange 45 engaging with the bottom surface of the pressure plate 35.

The backing plates 29 and 31, the friction plate 30, the inflatable hoses 32 and 34' the pressure plates 33 and 35' and the backing member 36 with the friction member 37 all extend longitudinally within the mould 10 substantially along the total length of the mould part which is covered by the removable top wall or lid 15. While the pressure plate 33 and the pressure plate 35 with the friction member 37 are transversely movable within the mould as described in more detail below, these pressure plates and the backing plates 29 and 31 as well as the friction plates 30 and 37 are not moved longitudinally in relation to the mould during compression operation.

The backing plates or members 29, 31, and 36 and the pressure plates 33 and 35 may be made from wood material, such as plywood, plastics material or metal, such as steel or aluminum, while the friction plates or friction members 30 and 37 are preferably made from steel, such as stainless steel, aluminum or another metal.

A prismatic or beam-like wood sample 46, in which the grain or wood fibres extend in the longitudinal direction of the sample and which has been pretreated by heating in the presence of moisture, may be compressed longitudinally in the compression mould 10. The sample 46 is arranged in a compression chamber defined between the backing plate 31 and the pressure plate 33 and between the lower and upper friction plates or members 30 and 37. A pair of heatable friction plates 47 and 48, which are arranged so as to be longitudinally movable in relation to the compression mould 10 are arranged on either side of the wood sample 46, and filler members 49 and 50 fill the spaces between the backing plate 31 and the friction plate 47 and between the pressure plate 33 and the friction plate 48, respectively. The thickness of the filler members 49 and 50, which may, for example, be made from wood, such as plywood, may be chosen depending on the transverse dimension of the sample 46. The filler members or filler plates 49 and 50 are arranged so as to be movable together with the friction plates 47 and 48 in the longitudinal direction of the mould in relation to the stationary backing plates 31 and the pressure plate 33. In order to reduce the frictional forces between the plates 31 and 49 the inner surface of the backing plate 31 may be provided with a layer 51 of a friction reducing material, such as Teflon®. Similarly, the inner surface of the pressure plate 33 is coated with a layer 52 of a friction reducing material, such as Teflon®.

The vertical dimension of the compression plate or member 20 fastened to the piston rod 19 of the cylinder 18 corresponds substantially to the vertical dimension of the wood sample 46 (FIG. 2). and the horizontal dimension of the compression member 20 corresponds substantially to the spacing between the layers 51 and 52 of friction reducing material. The inner side surface of the block-shaped abutment member 23 is in abutting engagement with the adjacent end surface of the wood sample 46 and with the adjacent end surfaces of the backing plate 29 with the friction plate 30 and of the beam-like backing member 36 with the friction member 37. Furthermore, the horizontal dimension of the abutment member 23 substantially corresponds to the horizontal width of the wood sample 46.

As shown in FIG. 1, each of the inflatable hoses 32 and 34 which may for example, be a fire hose section, is tightly closed at both ends by means of clamping devices 53. Furthermore, each of the hose lengths 32 and 34 is divided into a shorter hose section 54 and a longer hose section 55 by means of a clamping device 56 tightly separating these two sections. Compressed air may be supplied to each of the hose sections from a compressed air source (not shown) through supply conduits 57 and 58.

As shown in FIG. 2, each of the friction plates 47 an 48, which are preferably made from aluminum, may be divided into an outer main plate 59 and an inner cover plate 60 connected thereto. The main plate 59 may be provided with channels or bores for receiving heating means 61 therein, such as electrical heating elements. A central channel or bore 62 may receive a thermostat for controlling the supply of current or another heating energy to the heating means 61. Bores or passages 63 for conducting a cooling medium may also be defined in the outer main plates 59. As shown in FIG. 1, the end portions of the friction plates 47 and 48 and of the filler members 49 and 50 may pass through the spacings defined between the block-shaped abutment member 23 and the adjacent inner surfaces of the mould side walls 12 and 13. These end portions of the frictions plates 47 and 48 may be connected to electric cables 64 for supplying electric power to the electric heating means 61 embedded in the main plates 59.

The apparatus described above may be operated as follows:

The block-shaped abutment member 23 is released and removed from the compression mould 10 so as to allow insertion of the wood sample 46 to be compressed. The wood sample 46, which has preferably been heated by steam, for example at a temperature of 100°-110° C., should have a water content which is preferable not less than 20 per cent. Now, the abutment member 23 is repositioned so that one end of the sample 46 is in abutting engagement with the abutment member 23, while the opposite end surface of the sample is in engagement with the compression plate 20 of the hydraulic cylinder 18. The friction plates 47 and 48 and the filler plates 49 and 50 may then be inserted into the mould so as to extend along the side surfaces of the sample 46. Compressed air is now supplied to the hose sections 54 and 55 through the supply conduits 57 and 58, whereby the pressure plate 35, backing member 36, and the friction member 37 are moved downwardly so as to resiliently force the friction member 37 into frictional engagement with the upper side surface of the wood sample 46, and the lower side surface of the sample is simultaneously forces into engagement with the friction plate 30. Similarly, the pressure plate 33 the filler member 50, and the friction plate 48 are moved transversely inwardly, whereby the friction plates 47 and 48 are resiliently pressed into frictional engagement with the respective opposite side surfaces of the wood sample 46. The pressure of the compressed air supplied to the hose sections 54 and 55 is controlled so that the desired frictional forces are obtained between the wood sample 46 and the surface parts of the friction plates and members engaging therewith.

Hydraulic pressure is now supplied to the hydraulic cylinder 18 through hydraulic supply conduits 65 from a hydraulic pressure source, not shown. The hydraulic pressure source and the compressed air source may be arranged within a housing 66 which may be provided with pressure gauges or manometers 67 as shown in FIG. 1. When the hydraulic cylinder 18 is actuated the compression plate 20, which is in engagement with the adjacent end surfaces of the wood sample 46, the friction plates 47 and 48, and the filler plates 49 and 50, is moved towards the block-shaped abutment member 23, and the compressive pressure exerted by the compression plate may be up to 350 kg/cm$^2$. The abutment member 23 prevents longitudinal movement of the sample 46, the backing plate 29 with the friction plate 30 and of the backing member 36 with the friction member 37. However, the abutment member 23 does not block longitudinal movement of the friction plates 47 and 48 and of the filler plates 49 and 50. When the piston rod 19 of the cylinder 18 moves the pressure plate 20 to the right in FIG. 1, the wood sample 46 will be compressed longitudinally, while the end portions of the friction plate 47 and 48 and of the filler plates 49 and 50 are moved out from the mould 10. Electrical power may be supplied through the cables 64 so as to heat the sample during compression. The heating may be in the form of resistance heating, high frequency heating and/or micro wave heating.

It should be understood that not only the opposite end surfaces of the wood sample 46 are exposed to oppositely directed compressive forces, but also the side surfaces of the wood sample are exposed to oppositely directed frictional forces. Thus, the opposite vertical side surfaces of the wood sample 46 are exposed to frictional forces in the direction of movement of the friction plates 47 and 48, while the opposite horizontal side surfaces of the sample are exposed to oppositely directed frictional forces by the stationary friction plates or members 30 and 37. Consequently, the wood sample 46 is compressed by the combined action of the compressive forces applied to the opposite end surfaces of the sample and the compressive frictional forces applied to the opposite side surfaces of the sample, whereby it is possible to obtain a more uniform compression of the sample along its length, if desired. The compression of the various longitudinal sections of the sample may be controlled by controlling the pressure of the compressed air supplied to the hose sections 54 and 55 and/or by selecting suitable materials for forming the sample abutting surfaces of the friction plates and friction members. Furthermore, the compressive frictional forces may be changed by changing the roughness or smoothness of the sample engaging surfaces of the friction plates and members. As an example, the friction plates 47 and 48 may be made from aluminum, while the friction plate 30 and the friction member 37 may be made from stainless steel.

The frictional forces may also be varied along the length of any of the friction plates or members, for example by providing certain areas of the sample engaging surfaces with friction increasing projections, such as serrations or roughnesses and/or by applying a friction decreasing substance, such as talcum powder or Teflon ® to certain areas, whereby the compression of the wood sample 46 may be varied along the length of the sample as desired. Such variation of the compression of the sample may also be obtained by heating only certain longitudinal sections of the sample prior to and/or during the compression of the sample.

When the sample 46 is compressed longitudinally, the cross-sectional dimensions of the sample will increase, and the resilient inflated hose sections 54 and 55 allow such change in cross-sectional dimensions. The pressure of the compressed air supplied to the hose sections may be changed in the various hose sections during the compression, if desired.

When the compression plate 20 has been moved a certain distance into the space defined between the stationary upper and lower friction plates 30 and 37 and between the backing and pressure plates 31 and 33, whereby the wood sample 46 has been shortened substantially by the compressive forces applied thereto, the pressure of the compressed air supplied to the hose sections may be reduced and eventually completely released in order to prevent jamming of the compression plate 20 due to inward deflection of the end portions of the plates 30, 31, 33, and 37 which are now unsupported by the wood sample 46. The inflatable hoses 32 and 34 could, of course, be divided into a greater number of longitudinal sections, whereby the transverse clamping of the sample 46 may be even more closely controlled.

It should be understood that the extent to which the sample 46 is compressed longitudinally depends i.a. on the type of wood being compressed and on the bending characteristics desired for the final product. It has been found, however, that if a substantially uniform compression is desired along the length of the sample, it should advantageously be shortened to 75-85 per cent and preferably 80 per cent of its original length, and the compression should preferably performed over a relatively long period of time, such as 15.30 minutes.

As mentioned above, the wood sample 46 may be maintained in a heated condition, for example to about 80° C., during compression by means of the electric heating means 61. When the sample 46 has been compressed to the desired extent, it may be retained in the mould and cooled in its compressed condition before the compressive forces are released. Such cooling may, for example, be promoted by circulating a cooling medium through the bores or passages 63 formed in the main plates 59. When the compressed and cooled sample has been removed from the apparatus its length is reduced by about 20 per cent in relation to its original length and the sample will substantially maintain its shortened length and remain in a plastic condition, also when it has been dried. The dried sample may therefore be cut and/or machined to a desired shape and the shape may be changed several times. The wood sample still has a considerable strength and also a certain stability in shape.

Alternatively, the compressive forces applied to the compressed sample 46 within the compression mould 10 may be released while the sample is still in a heated condition. In that case the compressed sample 46 expands axially when the pressure is released and the remaining length shortening of the sample will be only 3–5 per cent compared to its original length. In this case, the sample remains in a plastic condition as long as its water content exceeds 20 per cent. Such a sample may be cut or machined to its desired dimensions and/or be bent to its final shape and dried. When dried the sample has substantially the same strength and stability in shape as before treatment of the sample. It has been found, however, that the modulus of plasticity has been somewhat reduced. As an example, the compressed sample 46 may be cut into a plurality of subsamples, such as lists or furniture parts, which are machined and bent separately. When the sample or subsamples have obtained their final shape, they are dried, whereafter this final shape becomes permanent. The drying process may take place in a mould or tool in which the sample is bent or deformed.

By the expression that the sample is in a "plastic" condition it should be understood that the sample may be bent or deformed, for example manually or by means of a bending tool, into a new lasting shape.

When a sample has obtained a plastic condition by compression this condition is maintained as long as the situation is unchanged. Thus, if a sample has been compressed longitudinally, and the compressive forces have been released when the sample was still in its heated condition, the water content of the sample should be retained, and if a sample has been cooled while maintained in its longitudinally compressed condition and subsequently dried, the dried condition should be maintained.

The operation of the apparatus shown in FIG. 1, such as the supply of fluid pressure to the hydraulic cylinder 18 and the supply of compressed air to the various hose sections 54 and 55 may be controlled by a preprogrammed electronic control unit 68 having a key board so that various information for example about the type of wood material to be heated may be read into the control unit.

We claim:

1. A method of compressing an elongate wood sample substantially in the direction of the grain or the fibres of the sample, said sample comprising side surfaces and end surfaces, said method comprising inserting the wood sample into a chamber substantially defined by side wall parts adapted for engaging and supporting the side surfaces of the sample for preventing deflection, and by a first and a second end wall part adapted for engaging respective end surfaces of the sample, moving said first end wall part in a direction along said side wall parts and towards said second end wall part while controlling or restricting the motion of said second end wall part in order to compress the wood sample between said end wall parts, and moving a portion of said side wall parts extending substantially in the total length of the sample together with said first end wall part in a fixed relationship, while controlling or restricting the motion of said remaining portion of the side wall parts also extending substantially in the total length of the sample so as to maintain a fixed relationship between said remaining portion of said side wall parts and said second end wall part.

2. The method of claim 1, wherein deflection of the sample is prevented by resiliently applying transversely directed forces to side surfaces of the sample.

3. The method of claim 1, wherein longitudinally directed forces are applied to a pair of opposite sample side surface parts for each of the opposite longitudinal directions along said side wall parts by the friction between respective side surfaces of the sample and respective corresponding side wall parts, said corresponding side wall parts being resiliently pressed onto the sample side surfaces.

4. The method of claim 3, wherein increased frictional forces are applied to selected areas of said side surface parts of the sample.

5. The method of claim 1, wherein at least a section of said sample is preheated prior to or during the compression of the sample, for example by heat, radio-wave or micro-wave radiation, visible or invisible light radiation, steam and/or chemicals.

6. An apparatus for compressing an elongate wood sample substantially in the direction of the grain or the fibres of the sample, said sample comprising side surfaces and end surfaces, said apparatus comprising a chamber for receiving the sample, said chamber being substantially defined by side wall parts adapted for engaging and supporting the side surfaces of the sample for preventing deflection, and by a first and a second end wall part adapted for engaging respective end surfaces of the sample, a first one of said end wall parts being movable in a direction along said side wall parts, means for moving said first end wall part in a direction along said side wall parts and towards said second end wall part, and means for controlling or restricting the motion of said second end wall part in order to compress the wood sample between said first and said second end wall part, said side wall parts comprising a first group of side wall parts extending substantially in the total length of the sample and a second group of side wall parts extending substantially in the total length of the sample, said first group of side wall parts being displaceable longitudinally relative to said second group of side wall parts, said first group of side wall parts being connected to be moved in a fixed relationship with said first end wall part, whereas said second group of side wall parts is connectable to be controlled in a fixed relationship with said second end wall part.

7. The apparatus of claim 6, wherein said side wall parts are arranged in pairs of oppositely positioned side wall parts, each pair being connected or connectable with a respective one of said end wall parts.

8. The apparatus of claim 6, wherein said side wall parts are pressed transversely to frictional engagement with the sample side surfaces resilient means.

9. The apparatus of claim 8, wherein said resilient means comprise inflatable means, whereas said means for applying oppositely directed compressive forces to said end wall parts comprise a hydraulic cylinder or jack.

10. The apparatus of claim 9, comprising:

a compression mould defined substantially by a bottom wall, a top wall, a pair of opposite side walls, and an end wall, said bottom wall, top wall and side walls being stationary parts adapted for enclosing an supporting said first group and said second group of side wall parts and said resilient means, said end wall being adapted for supporting said means for moving said first end wall part, removable means for holding said second end wall part stationary in said mould, means for arresting said second group of side wall parts so as to resist their displacement in the longitudinal direction, and respective friction reducing layers arranged between said first group of said wall parts and adjacent other parts of the apparatus, supporting said first group of side wall parts, so as to allow longitudinal displacement while resisting transverse displacement.

* * * * *